US010342346B2

(12) United States Patent
Hansen et al.

(10) Patent No.: US 10,342,346 B2
(45) Date of Patent: Jul. 9, 2019

(54) UNIVERSAL CONNECTOR BRACKET FOR A STORAGE SYSTEM

(71) Applicant: RUBBERMAID INCORPORATED, Huntersville, NC (US)

(72) Inventors: Joshua M. Hansen, Mattawan, MI (US); Edward Naguit Abante, Kalamazoo, MI (US); Michael Defenbaugh, Dunwoody, GA (US); Steven Jay Muske, Marietta, GA (US); Jonathan David Klinger, Charlotte, NC (US); Scott Loren Miller, Davidson, NC (US)

(73) Assignee: RUBBERMAID INCORPORATED, Huntersville, NC (US)

( * ) Notice: Subject to any disclaimer, the term of this patent is extended or adjusted under 35 U.S.C. 154(b) by 112 days.

(21) Appl. No.: 15/000,449

(22) Filed: Jan. 19, 2016

(65) Prior Publication Data

US 2016/0206095 A1 Jul. 21, 2016

Related U.S. Application Data

(60) Provisional application No. 62/104,428, filed on Jan. 16, 2015.

(51) Int. Cl.
*A47B 96/06* (2006.01)

(52) U.S. Cl.
CPC ..... *A47B 96/06* (2013.01); *A47B 96/067* (2013.01); *A47B 96/068* (2013.01)

(58) Field of Classification Search
CPC ..... A47B 96/06; A47B 96/067; A47B 96/068; A47B 96/07
See application file for complete search history.

(56) References Cited

U.S. PATENT DOCUMENTS 532,109 A * 1/1895 Stinchcomb et al. ..... A47G 25/0607 248/303
2,743,148 A * 4/1956 Tedaldi ..... A47F 5/005 312/140.3
2,841,353 A * 7/1958 Burdick ..... A47F 5/0823 248/220.21
D416,471 S * 11/1999 Wurdack ..... D8/363
6,497,395 B1 * 12/2002 Croker ..... H02G 3/30 211/103
6,643,900 B2 * 11/2003 Jahrling ..... A47B 55/02 24/336
D495,588 S * 9/2004 Wurdack ..... D8/367
7,427,053 B2 * 9/2008 Nawrocki ..... A47F 5/0006 211/57.1

(Continued)

*Primary Examiner* — Stanton L Krycinski
(74) *Attorney, Agent, or Firm* — Marshall, Gerstein & Borun LLP

(57) ABSTRACT

A universal connector bracket including a bracket body, a first mounting feature defined by the bracket body, and a second mounting feature defined by the bracket body and distinct from the first mounting feature. The first mounting feature is structured and arranged to engage a horizontal support of a storage system. The second mounting feature is structured and arranged to engage a vertical support of a storage system. As such, the universal connector bracket can be coupled to one of the vertical or horizontal support, or can be coupled to both the vertical and horizontal support at the same time.

16 Claims, 13 Drawing Sheets

(56) References Cited

U.S. PATENT DOCUMENTS

| | | | | |
|---|---|---|---|---|
| 7,757,869 | B2 * | 7/2010 | Lawson | A47F 5/0846 211/59.1 |
| 8,087,521 | B2 * | 1/2012 | Schwartzkopf | A47B 96/061 211/103 |
| 8,695,816 | B2 * | 4/2014 | Troyner | A47B 57/402 211/103 |
| 2007/0102604 | A1 * | 5/2007 | Nawrocki | A47B 57/40 248/220.31 |
| 2010/0213346 | A1 | 8/2010 | Chen | |
| 2010/0219144 | A1 * | 9/2010 | Salmon | A47B 96/067 211/94.01 |
| 2012/0091086 | A1 * | 4/2012 | Gregory | A47B 96/067 211/86.01 |

* cited by examiner

UNIVERSAL CONNECTOR BRACKET FOR A STORAGE SYSTEM

FIELD OF THE DISCLOSURE

The present disclosure is directed to universal connector brackets and, more particularly to a universal connector bracket for use in a storage system.

BACKGROUND

Homeowners have expressed frustration with the complexity and variety of hardware needed to install shelving. Some known storage systems include hardware that allows homeowners to install shelves on vertical supports, while other known storage systems include hardware that allows homeowners to install shelves on horizontal supports. Homeowners may not, however, realize, until they return home, until after installation, or until they wish to re-orient the shelving, that the hardware they purchased was only designed for installing shelves on one type of support (horizontal or vertical). In some cases, homeowners may have to return and exchange hardware. In other cases, homeowners may have to purchase multiple different types of hardware to install shelves on both vertical supports and horizontal supports.

SUMMARY

In one aspect, a bracket includes a bracket body, a first mounting feature defined by the bracket body, and a second mounting feature defined by the bracket body. The first mounting feature is structured and arranged to engage a horizontal support. The second mounting feature is structured and arranged to engage a vertical support.

In other aspects, the bracket may include a wire form coupled to the bracket body. The wire form may provide a support adapted to receive a shelf. The wire form may be welded to the bracket body. The shelf may be welded to the wire form.

In other aspects, the first mounting feature may include a pair of projections and a pair of arms. The projections may be structured and arranged to engage a top portion of the horizontal support, and the arms may be structured and arranged to engage a bottom portion of the horizontal support.

In other aspects, the second mounting feature may include at least first and second hooks formed on the bracket body. The first hook may be structured and arranged to engage a first portion of the vertical support. The second hook may be structured and arranged to engage a second portion of the vertical support different from the first portion of the vertical support.

In another aspect, a storage system includes a horizontal support, a vertical support, and a first bracket. The horizontal support is mounted to a surface. The vertical support is mounted to the surface or to the horizontal support. The first bracket includes a body, a first mounting feature defined by the body, and a second mounting feature defined by the body and distinct from the first mounting feature. The first mounting feature is structured and arranged to engage the horizontal support. The second mounting feature is structured and arranged to engage the vertical support.

In some aspects, the storage system may include a wire form coupled to the body. The storage system may additionally include a second bracket and a shelf. The shelf may be structured and arranged to be coupled (e.g., welded) to the wire forms of the first and second brackets.

In other aspects, the horizontal support may include a horizontal rail mounted to a garage wall, and the vertical support may be mounted to the garage wall or the horizontal rail.

In other aspects, the first mounting feature may be structured and arranged not to engage the vertical support when the second mounting feature engages the vertical support.

In other aspects, the second mounting feature may be structured and arranged not to engage the horizontal support when the first mounting feature engages the horizontal support.

In other aspects, the first mounting feature and the second mounting feature may simultaneously engage the horizontal support and the vertical support, respectively.

In yet another aspect, a bracket includes a bracket body, a first mounting feature defined by the bracket body, and a second mounting feature defined by the bracket body. The first mounting feature is structured and arranged to engage a horizontal support. The second mounting feature is structured and arranged to engage a vertical support. The first mounting feature includes a pair of projections and a pair of arms. The projections are structured and arranged to engage a top portion of the horizontal support, and the arms are structured and arranged to engage a bottom portion of the horizontal support. The second mounting feature includes at least first and second hooks formed on the bracket body. The first hook is structured and arranged to engage a first portion of the vertical support. The second hook is structured and arranged to engage a second portion of the vertical support different from the first portion of the vertical support.

In some aspects, each arm may include a spring-loaded retention feature structured and arranged to securely engage the bottom portion of the horizontal support. In one form, each spring-loaded retention may include an undulating, curved retention feature defined by two peaks and a valley located between the two peaks.

In other aspects, the bracket body may be defined by a front wall and a pair of sidewalls extending rearward from the front wall. The projections may extend rearward and downward from the sidewalls, respectively, and the arms may extend laterally outward or rearward from the sidewalls, respectively.

In other aspects, the bracket body may be defined by a front wall and a pair of sidewalls extending rearward from the front wall. The first hook may extend rearward from the front wall proximate to a top portion of the front wall, and the second hook may extend rearward from the front wall proximate to a bottom portion of the front wall.

BRIEF DESCRIPTION OF THE DRAWINGS

The disclosure may be best understood by reference to the following description taken in conjunction with the accompanying drawings, in which like reference numerals identify like elements in the several FIGS., in which.

DETAILED DESCRIPTION

The present disclosure is directed to a universal connector bracket that allows homeowners to install shelving on a vertical support, a horizontal support, or both at the same time, thereby offering homeowners greater flexibility.

FIGS. 1-4 depict an example of a universal connector bracket constructed in accordance with the principles of the present invention. The universal connector bracket illustrated in FIGS. 1-4 is a bracket 100 for use in a storage system (e.g., the FastTrack Garage Organization System manufactured by Rubbermaid), as will be described in greater detail below. The bracket 100 can be made of or manufactured from steel (e.g., powder coated steel), another type of metal, plastic, some other suitable material(s), or combinations thereof. The bracket 100 generally includes a body 104, a first mounting feature 108 defined by the body 104, and a second mounting feature 110 also defined by the body 104 but structurally separate such that it is distinct from the first mounting feature 108.

Figure 1:
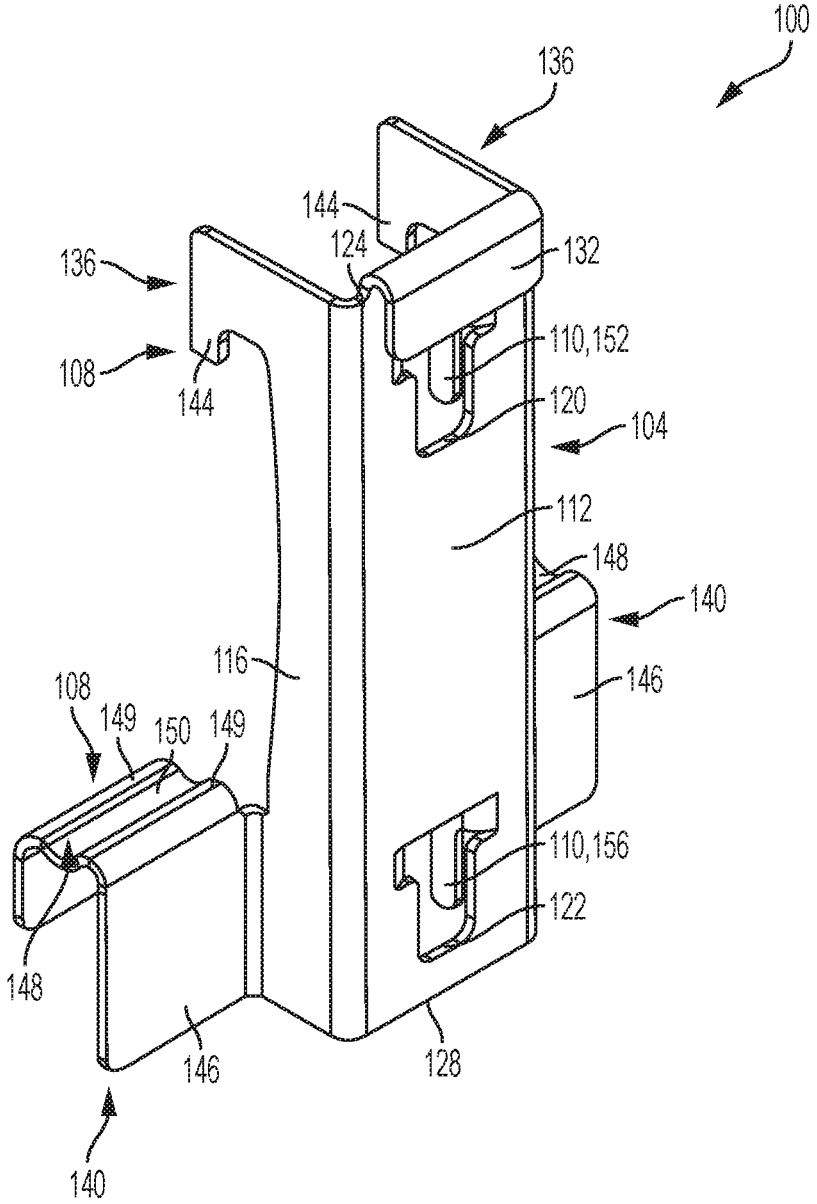
FIG. 1 is a perspective view of a universal connector bracket constructed in accordance with the principles of the present disclosure.
Figure 2:
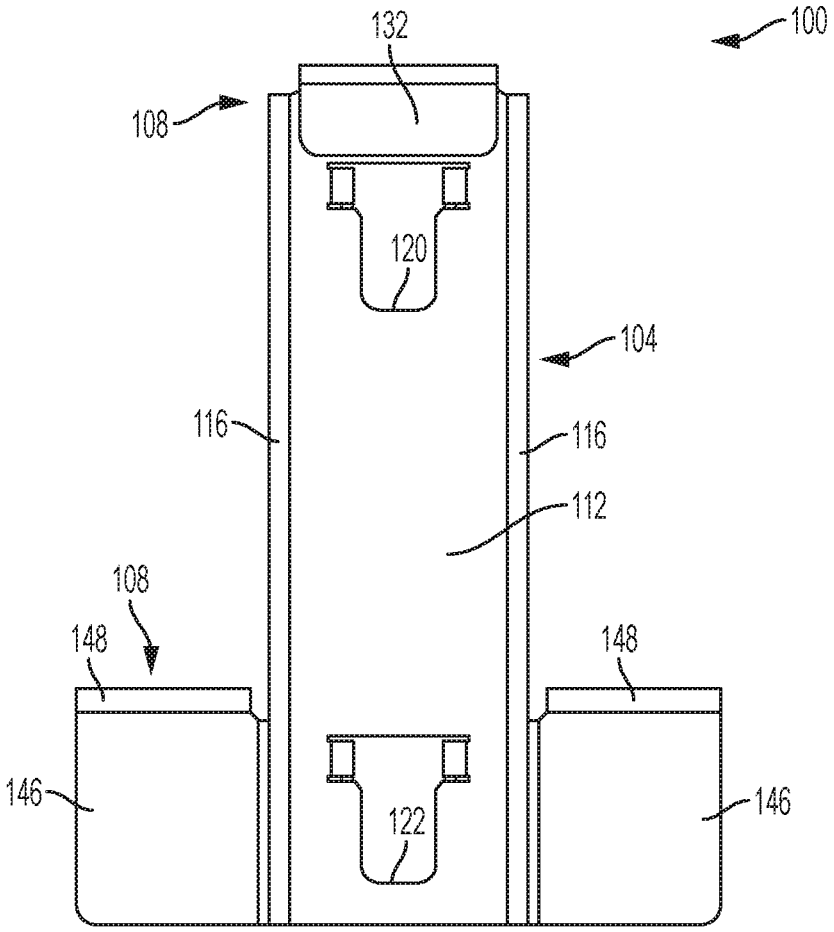
FIG. 2 is a front view of the universal connector bracket of FIG. 1.
Figure 3:
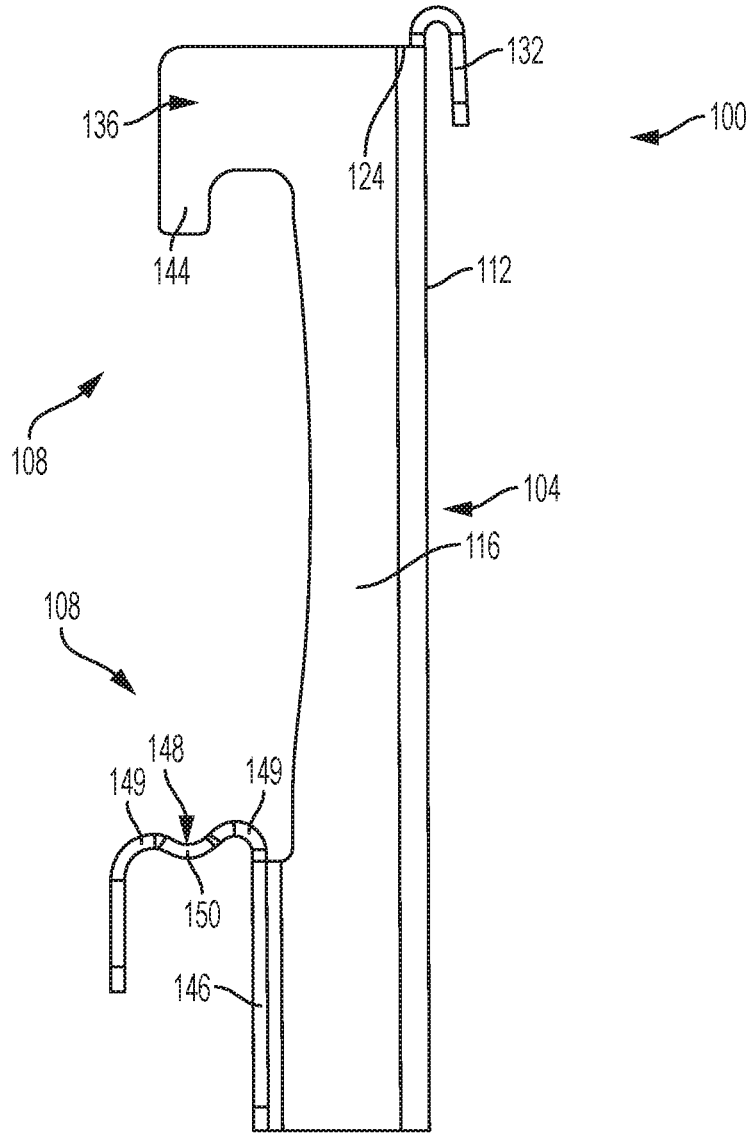
FIG. 3 is a side view of the universal connector bracket of FIG. 1.

As shown in FIGS. 1-4, the body 104 is defined by three walls, a front wall 112 and side walls 116 that extend rearward from the front wall 112, thereby defining a body comprising an open U-shaped channel member. A pair of apertures 120, 122 are formed in the body 104. More specifically, the apertures 120, 122 are formed in the front wall 112 of the body 104, with one aperture 120 formed adjacent or proximate to a top 124 of the front wall 112 and the other aperture 122 formed adjacent to or proximate to a bottom 128 of the front wall 112. As illustrated in FIGS. 1 and 2, each aperture 120, 122 is substantially T-shaped in cross-section, but other shapes are also contemplated. The body 104 also includes a retention tab or hook 132 that is coupled to and extends outward (e.g., forward) and downward from the top 124 of the front wall 112. The retention tab 132 is structured and arranged to engage a shelf so as to help couple the shelf to the bracket 100.

The first mounting feature 108 is generally structured and arranged to engage a first component (e.g., a horizontal rail) of the storage system. As illustrated in FIGS. 1-4, the first mounting feature 108, which is defined by the body 104, takes the form of a pair of projections 136 and a pair of arms or wings 140. As illustrated, the projections 136 extend further in the rearward direction of the side walls 116. At an edge of the projection that is distal from the front wall 112, each projection 136 includes a downwardly extending tab or hook 144 structured and arranged to engage a first portion of the first component (e.g., the horizontal rail) of the storage system, as will be described in greater detail below. Each arm 140 includes a face 146 that extends laterally outward from the side walls 116, such that the face 146 is perpendicular to the side walls 116, as well as an undulating, curved retention feature 148 that is coupled to and extends rearward from a top portion of the face 146. The undulating, curved retention feature 148 is defined by two peaks 149 and a valley 150 located therebetween. In one aspect, the retention feature 148 is spring-loaded such that it can deflect under positive pressure and be substantially restored to its original form in the absence of such pressure, so as to provide a consumer with a positive indication (e.g., a clicking sound and feel) when the rail is successfully engaged by the first mounting feature 108. The retention features 148 are structured and arranged to engage a second portion of the first component (e.g., the horizontal rail) of the storage system, as will be described in greater detail below.

Figure 4:
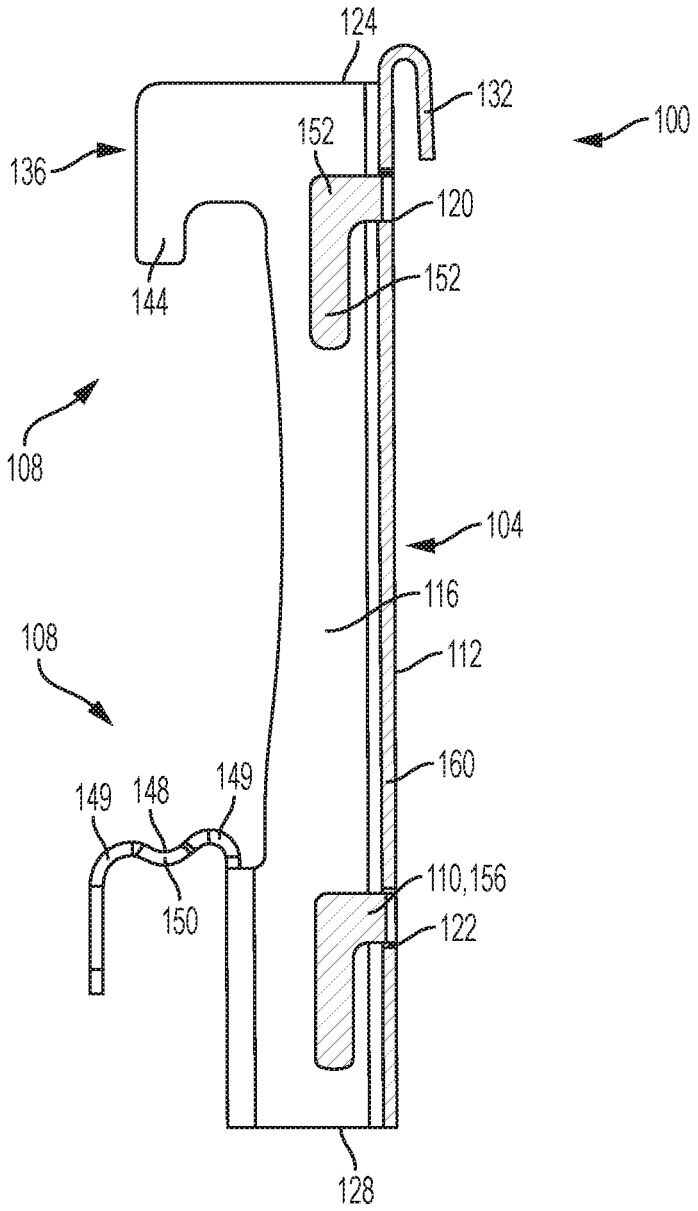
FIG. 4 is a cross-sectional view of FIG. 3.

The second mounting feature 110 is generally structured and arranged to engage a second component (e.g., a vertical upright) of the storage system, i.e., a different component than the first mounting feature 108. As best shown in FIGS. 1 and 4, the second mounting feature 110 includes a first pair of hooks 152 and a second pair of hooks 156. More specifically, the first pair of hooks 152 are formed on, and extend inward from, an inward-facing surface 160 of the front wall 112 adjacent or proximate to the first aperture 120, specifically between a respective sidewall 116 and the aperture 120, while the second pair of hooks 156 are formed on, and extend inward from, the inward-facing surface 160 adjacent or proximate to the second aperture 122, specifically between a respective sidewall 116 and the aperture 122. Each hook in the pair of hooks 152, 156 extends inward in a direction substantially parallel to an axis defined by sidewalls 116 and terminates in a downward direction as shown in FIG. 4. As such, the first pair of hooks 152 are structured and arranged to engage a first portion (or first portions) of the second component, while the second pair of hooks 156 are structured and arranged to engage a second portion (or second portions) of the second component, as will be described in greater detail below.

Figure 5:
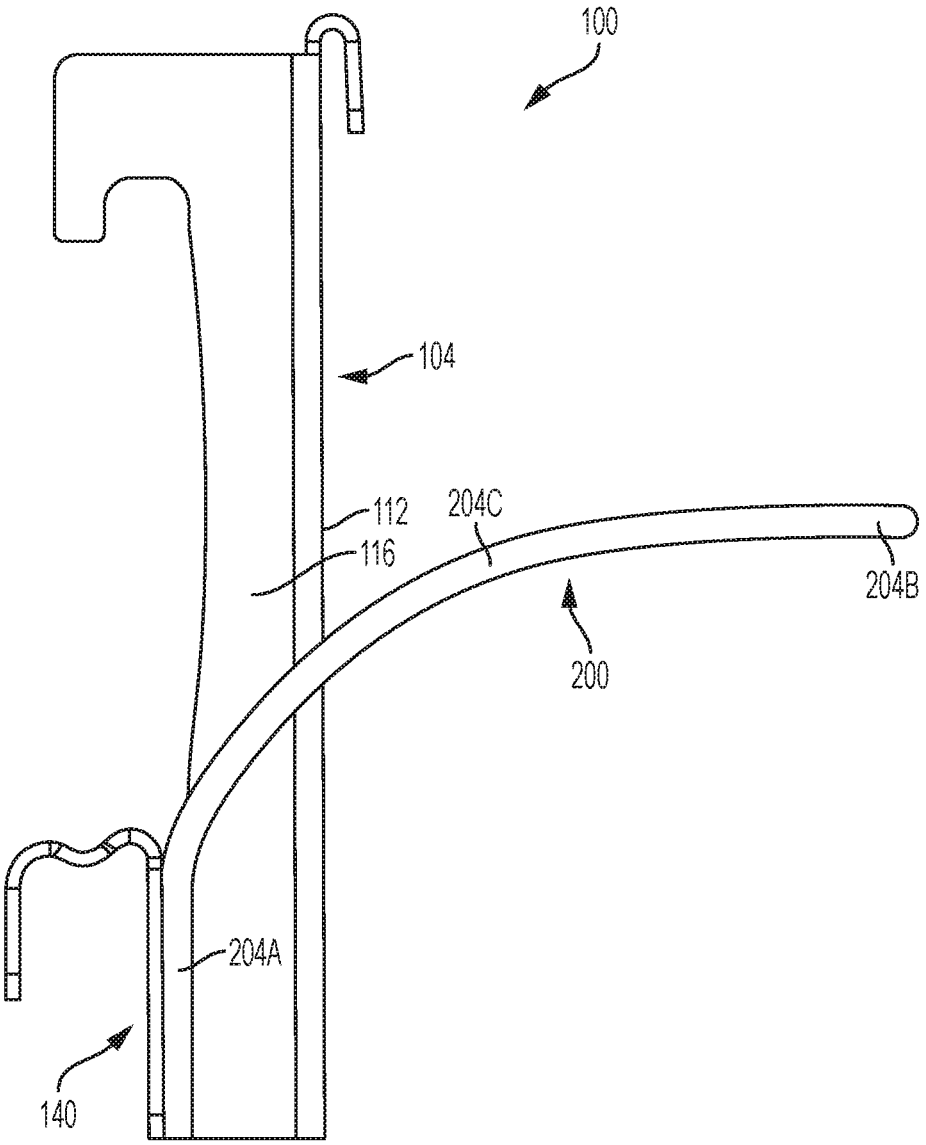
FIG. 5 is a side view showing the universal connector bracket of FIG. 3 with a wire form welded thereto for receiving a shelf.

Turning now to FIG. 5, the bracket 100 typically further includes a pair of wire forms 200 (only one being visible in FIG. 5) welded or otherwise coupled (e.g., adhered) to the body 104 of the bracket 100. Each wire form 200 is defined by a substantially vertical portion 204A, a substantially horizontal, free portion 204B, and a curved portion 204C extending between and connecting the vertical and horizontal portions 204A, 204B. The substantially vertical portion 204A of each wire form 200 is typically welded or otherwise coupled (e.g., adhered) to the body 104 between the respective sidewall 116 and the respective arm or wing 140. The portions 204B, 204C extend upward and outward from the vertical portion 204A. The substantially horizontal, free portion 204B of each wire form 200 is adapted to receive a shelf of the storage system. In some cases, the substantially horizontal, the free portion 204B of each wire form 200 may be welded or otherwise fixedly coupled (e.g., adhered) to a shelf, such that a shelf is welded or otherwise fixedly coupled (e.g., adhered) to the wire forms 200 (rather than, for example, removably coupled thereto).

Figure 6:
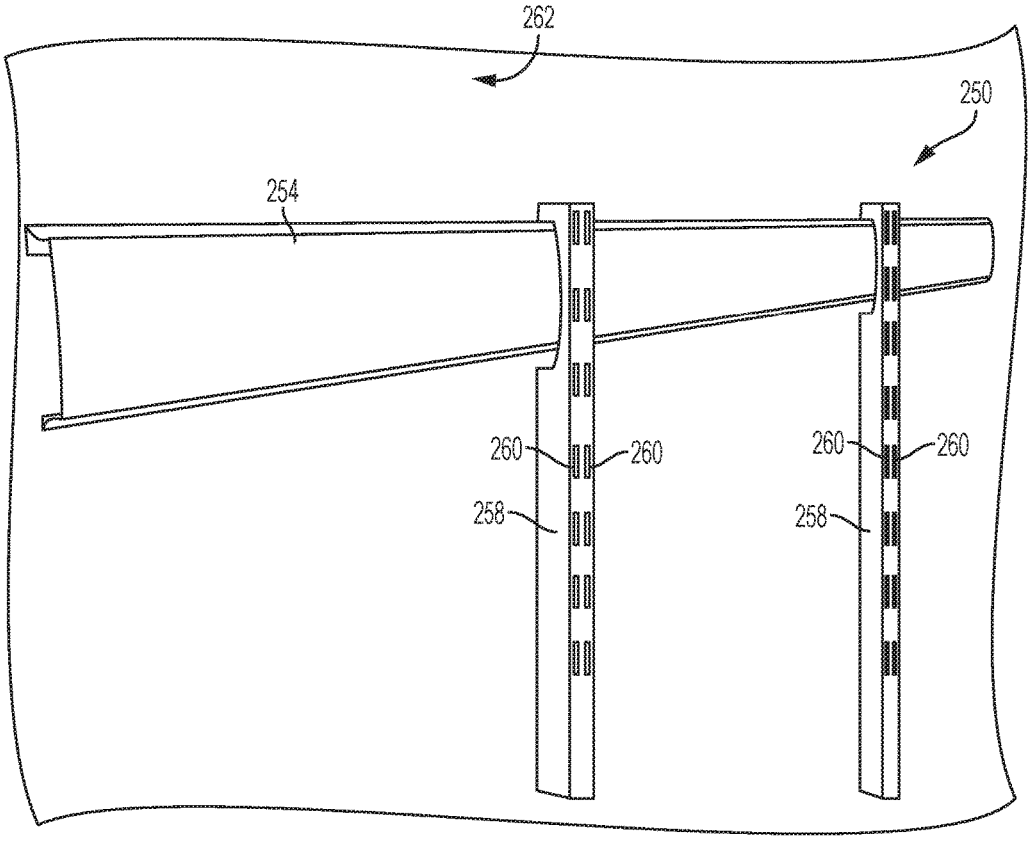
FIG. 6 is a perspective view of an example storage system that can be used in connection with the universal connector bracket of FIGS. 1-5.

As noted above, the bracket 100 is constructed for use with a storage system. FIG. 6 illustrates an example of such a storage system, in the form of storage system 250. In this example, the storage system 250 is a garage organizational system (e.g., the FastTrack Garage Organization System, manufactured by Rubbermaid) that includes a horizontal support 254 and a pair of vertical supports 258. The horizontal support 254 in this example is a rail mounted to a garage wall 262, while each vertical support 258 is an upright mounted to the horizontal support 254. As is known in the art, each vertical support 258 includes a plurality of slots 260 adapted to receive and securely retain a variety of different brackets (e.g., the brackets 100), which may in turn receive and retain shelving, tools, lawn equipment, or other items. While the vertical supports 258 in this example are mounted directly to the horizontal support 254, the vertical supports 258 can instead be mounted to some other surface (e.g., the garage wall 262), as is well known.

It will be appreciated that multiple brackets 100 can be used with the storage system 250. For example, two brackets 100 can be used to support a shelf of the storage system 250. It will also be appreciated that the garage organizational system 250 can, in some cases, include additional rails, additional uprights, and/or other hardware (e.g., racks, hooks, clips, etc.) for storing and organizing tools, lawn equipment, bicycles, sports equipment, or other items. Moreover, it will also be appreciated that the bracket 100 can instead be used with a different type of storage system, provided that the storage system includes horizontal and vertical supports. Further yet, the organizational system 250 can be used in connection with a basement, a bedroom, a kitchen, or some other room or space instead of a garage.

Figure 7:
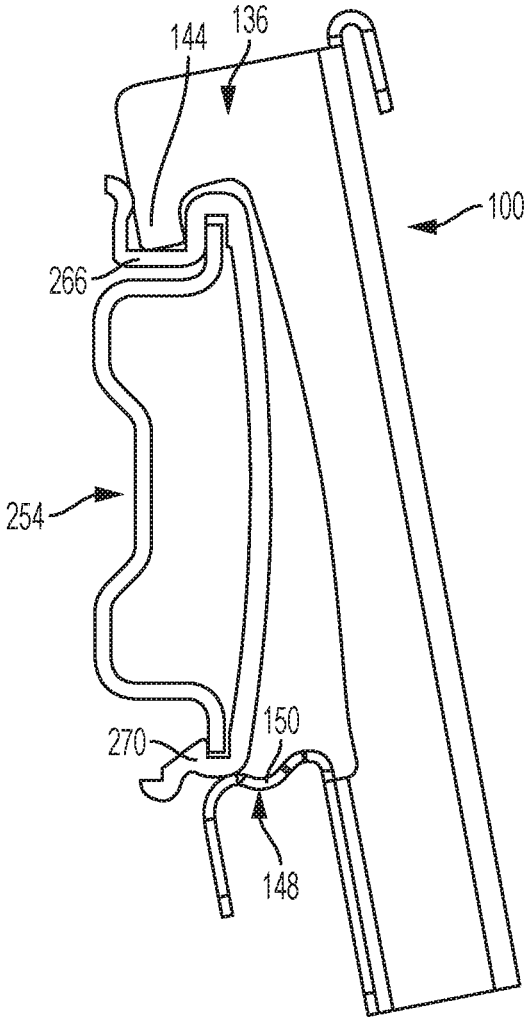
FIG. 7 illustrates the universal connector bracket of FIGS. 1-5 partially coupled to a horizontal support of the storage system of FIG. 6.

FIG. 7 illustrates the bracket 100 partially coupled to the horizontal support 254 of the storage system 250 illustrated in FIG. 6 via the first mounting structure 108. More specifically, the projections 144 of the first mounting structure 108 are in engagement with, and seated within, a top or upper U-shaped channel portion 266 of the horizontal support 254. This is accomplished by disposing the bracket 100 proximate or adjacent to the horizontal support 254 and then inserting the projections 144 of the first mounting structure 108 into the top or upper U-shaped channel portion of the horizontal support 254.

Figure 8:
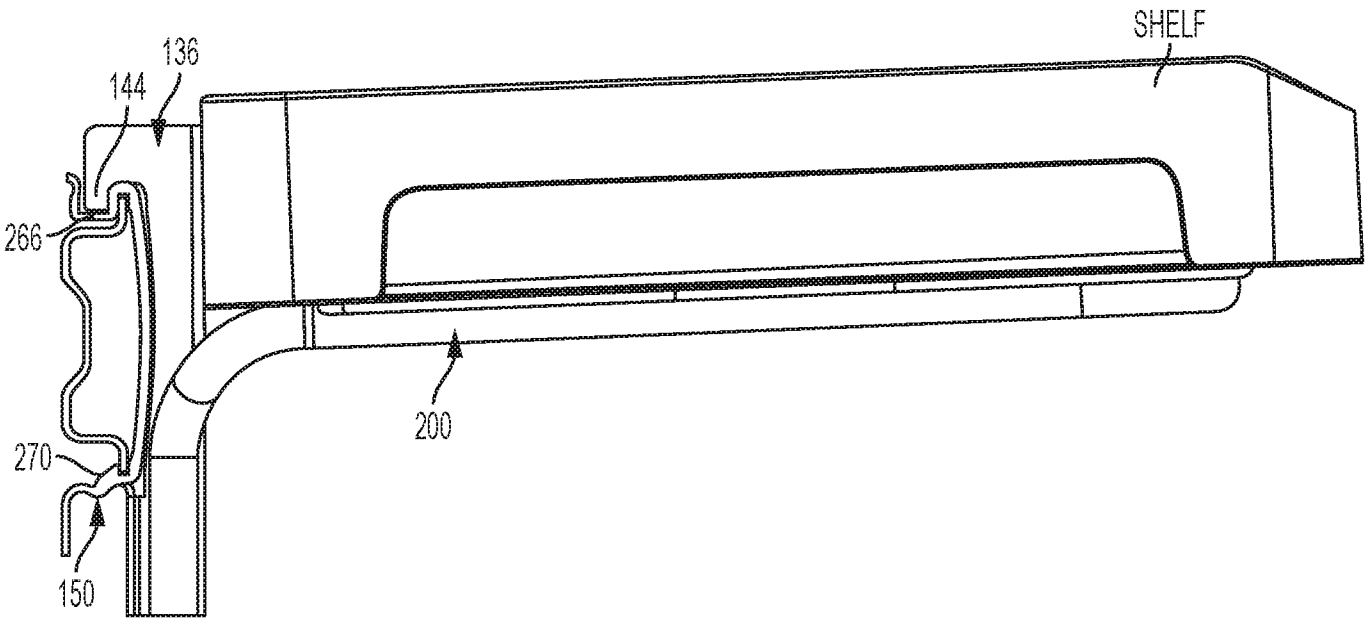
FIG. 8 illustrates the universal connector bracket of FIGS. 1-5 entirely coupled to the horizontal support of the storage system of FIG. 6.
Figure 9:
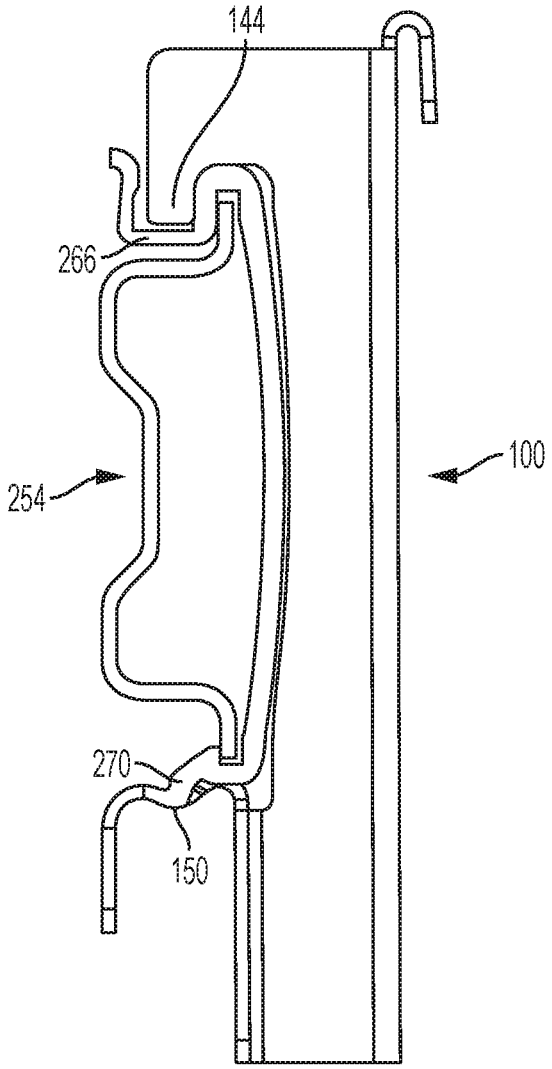
FIG. 9 is a close-up, partial view of FIG. 8 without the wire form.

FIGS. 8 and 9 illustrate the bracket 100 securely coupled to the horizontal support 254 via the first mounting structure 108. To reach this position, the bottom of the bracket 100, particularly the arms 140, are moved toward a bottom or lower portion of the horizontal support 254. The retention features 148, and more particularly the valleys 150 of each retention feature 148, can, in turn, be forced under and into engagement with a corresponding shaped and sized bottom or lower portion 270 of the horizontal support 254 either because the horizontal support 254 is partially formed from a deflectable material or the retention feature 148 is spring loaded. When the retention features 148 are spring-loaded, the retention features 148 deflect under positive pressure while being engaged with the bottom portion 270 of the horizontal support 254, and once successfully engaged with the bottom portion 270 of the support 254, are restored to an original condition or shape because of the spring bias, such that the retention features 148 operate to facilitate a secure connection to the horizontal support 254.

Figure 10:
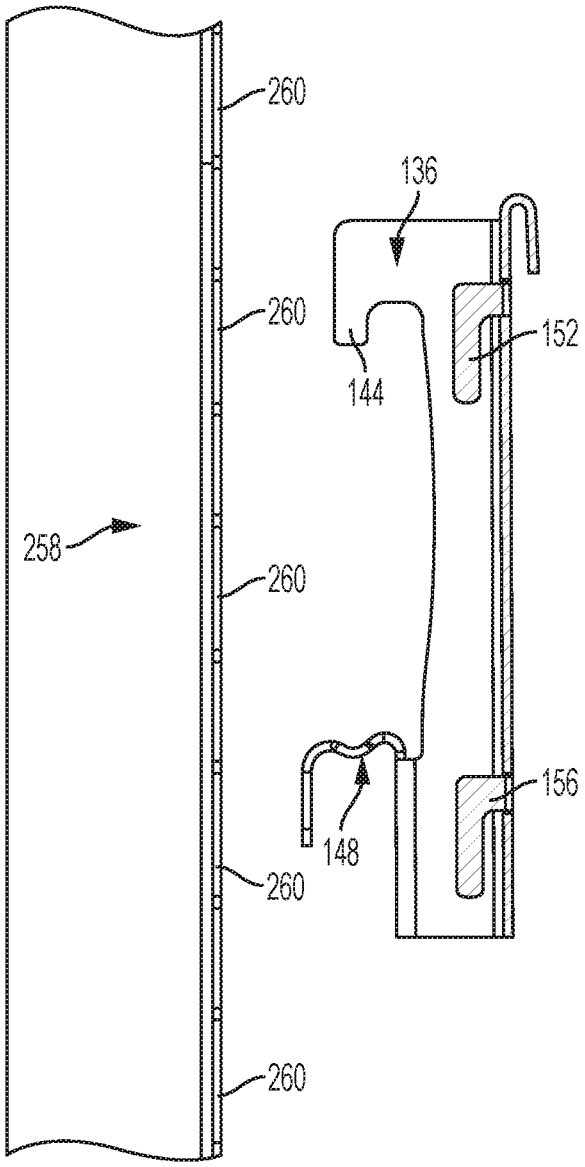
FIG. 10 illustrates the universal connector bracket of FIGS. 1-5 positioned adjacent a vertical support of the storage system of FIG. 6.
Figure 11:
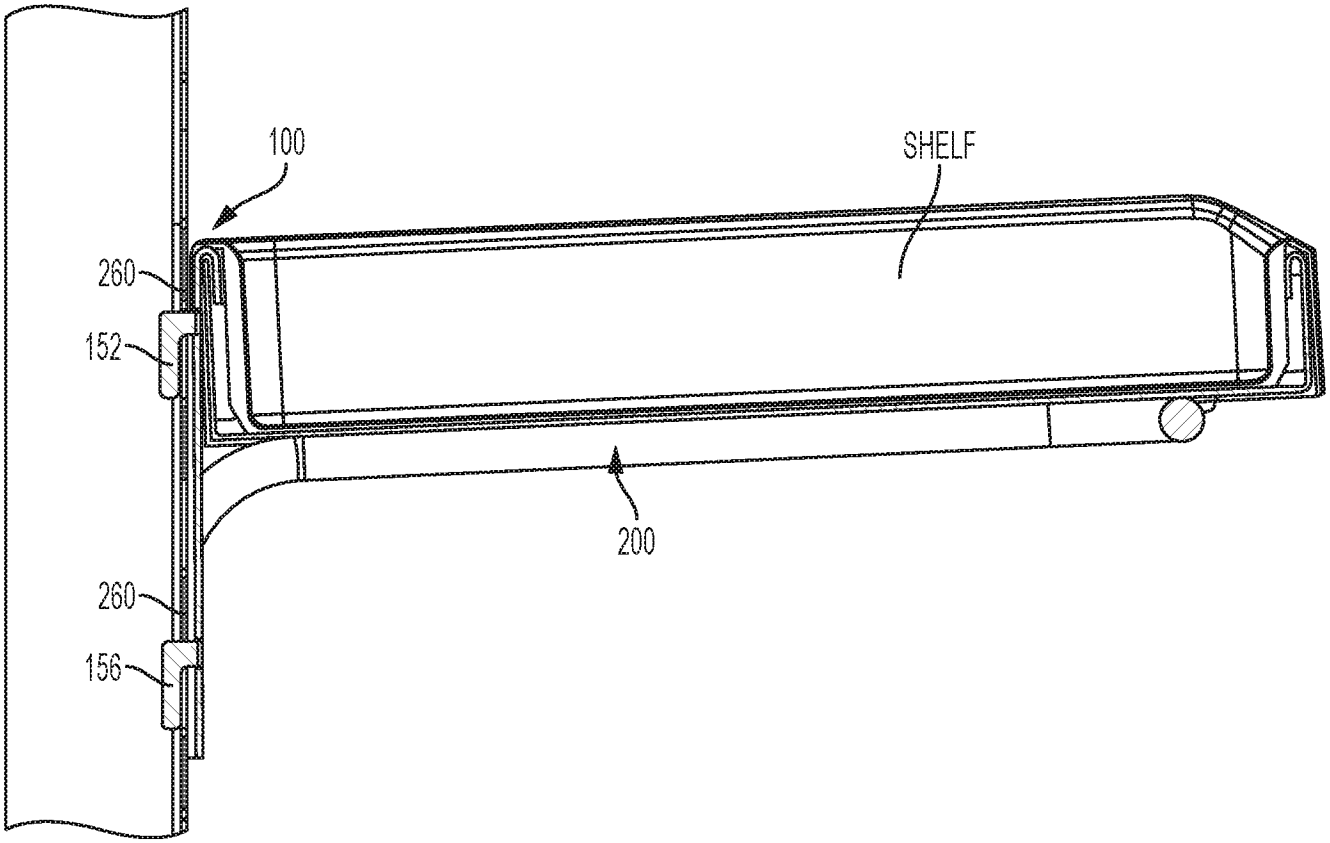
FIG. 11 is a cross-sectional view of the universal connector bracket of FIGS. 1-5 coupled to the vertical support.

FIG. 10 illustrates a close-up of the vertical support 258 of the storage system 250 and the bracket 100 positioned proximate or adjacent to the support 258. FIG. 11 illustrates the bracket 100 coupled to the vertical support 258, via the second mounting structure 110, at the desired height. More specifically, the first pair of hooks 152 is inserted into a pair of adjacent slots 260 of the support 258, and the second pair of hooks 156 is inserted into a different pair of adjacent slots 260 of the support 258 (the different pair of adjacent slots being positioned at a different height). To reach the position illustrated in FIG. 11, the bracket 100 is moved toward the vertical support 258, slightly rotated in a clockwise direction, and then the hooks 152, 156 are inserted into the corresponding slots 260, respectively, of the support 258.

Figure 12:
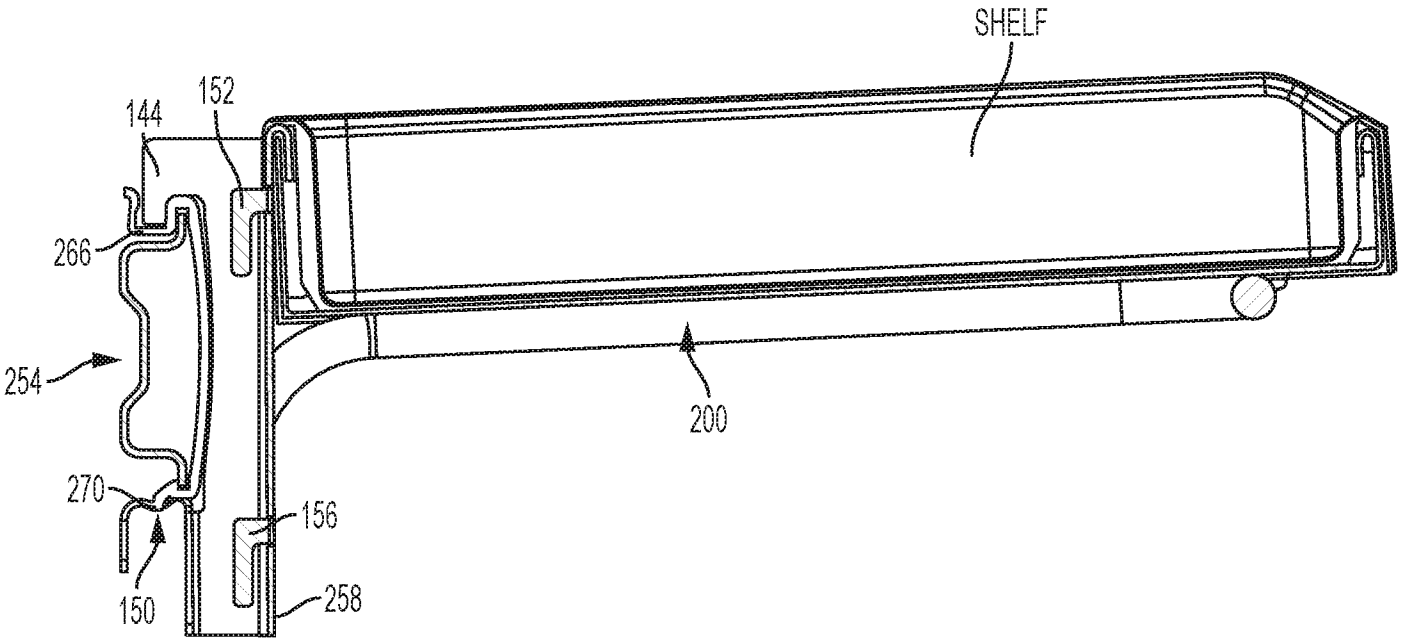
FIG. 12 illustrates the universal connector bracket of FIGS. 1-5 coupled to both the horizontal support and the vertical support of the storage system.

It will be appreciated that the bracket 100 can be decoupled from the horizontal support 254 or the vertical support 258 in a similar manner. In some cases, the bracket 100 can be decoupled from the support 254 or support 258 and then re-coupled thereto at a different position. It will also be appreciated that the bracket 100 can be simultaneously coupled to the horizontal support 254 and the vertical support 258. As illustrated in FIG. 12, the bracket 100 can be coupled to the horizontal support 254 via the first mounting structure 108 and, at the same time, coupled to the vertical support 258 via the second mounting structure 110. Importantly, when the bracket 100 is so coupled, the first mounting structure 108 is structured and arranged not to engage, and instead stay clear of, the vertical support 258 (to which the second mounting structure 110 is coupled), while the second mounting structure 110 is structured and arranged not to engage, and instead stay clear of, the horizontal support 254 (to which the first mounting structure 108 is coupled).

Figure 13:
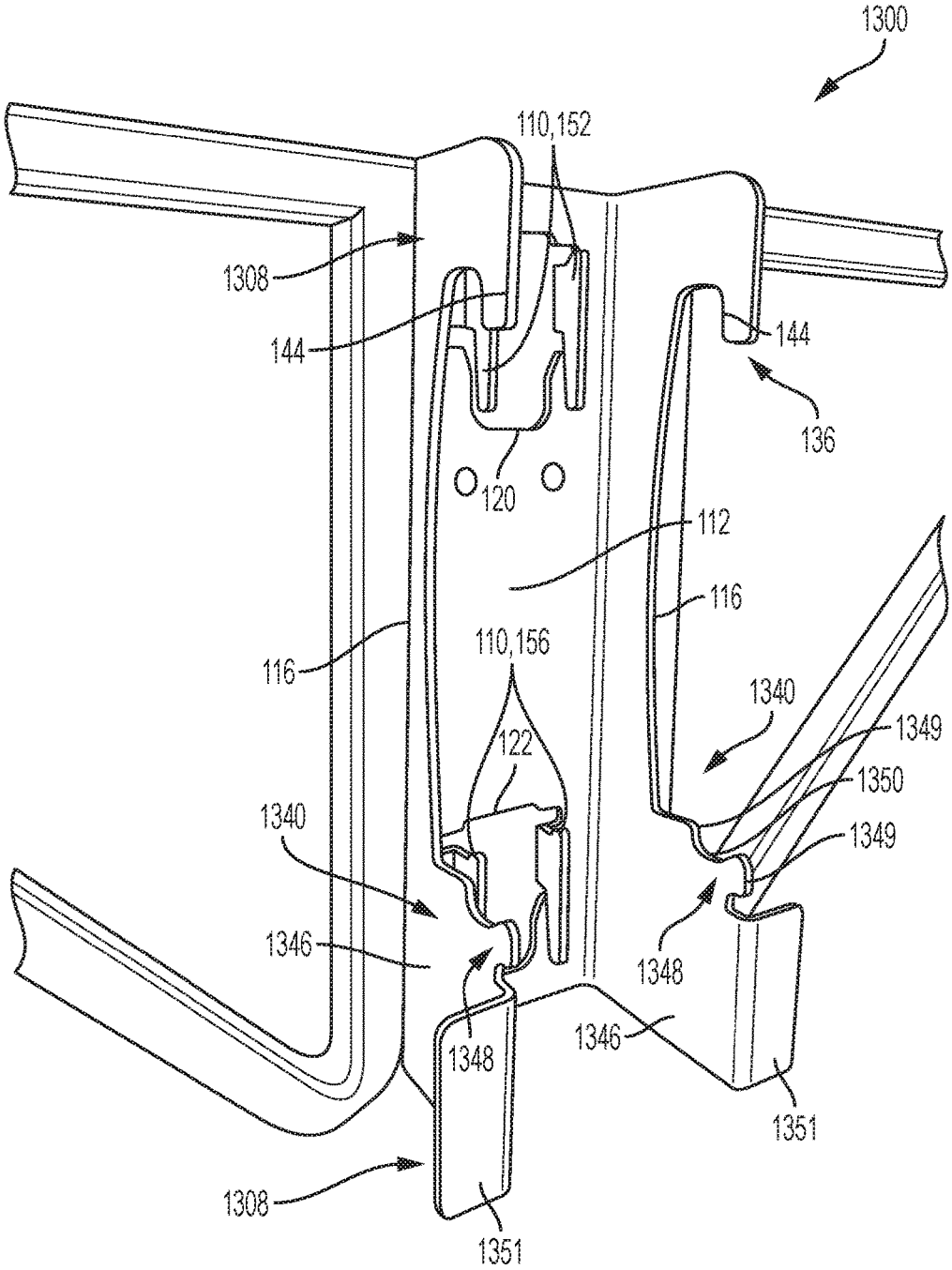
FIG. 13 is a perspective view of another universal connector bracket constructed in accordance with the principles of the present disclosure.

FIG. 13 depicts another example of a universal connector bracket constructed in accordance with the principles of the present invention. The universal connector bracket illustrated in FIG. 13 is a bracket 1300 that is similar to the bracket 100 described above, with common components illustrated using common reference numerals, and, like the bracket 100, can be used in a storage system. The bracket 1300 differs from the bracket 100 in that it includes a first mounting feature, depicted as first mounting feature 1308, that has a different form than the first mounting feature 108. As illustrated in FIG. 13, the first mounting feature 1308 includes the pair of projections 136 described above but also a pair of arms 1340 that differ from the pair of arms 140 described above. Each arm 1340 includes a face 1346 that extends rearward from the side walls 116, as well as an undulating, curved retention feature 1348 defined by or on the face 1346. The undulating, curved retention feature 1348 is defined by two peaks 1349 and a valley 1350 located therebetween. Like the retention features 148, the retention features 1348 are structured and arranged to engage a second portion of the first component (e.g., the horizontal rail) of the storage system. Each arm 1340 also includes a flange 1351 that extends laterally outward from, and generally orthogonal to, a respective face 1346. When the first mounting feature 1308 engages the first component (e.g., the horizontal rail) of the storage system, the flanges 1351 are structured and arranged to engage (e.g., rest flush against) the garage wall 262 (or other surface to which the first component is mounted) so as to provide additional stability and strength to the storage system. As also illustrated in FIG. 13, the bracket 1300 includes a pair of wire forms, e.g., the wire forms 200, welded or otherwise coupled (e.g., adhered) to the body 104 of the bracket 1300. As discussed above, the wire forms are adapted to receive a shelf of the storage system, which can be removably or fixedly coupled thereto.

The invention claimed is:

1. A bracket, comprising:

a bracket body defined by a front wall and a pair of sidewalls extending rearward from the front wall;

a first mounting feature defined by the bracket body, the first mounting feature structured and arranged to engage a horizontal support; and a second mounting feature defined by the bracket body and distinct from the first mounting feature, the second mounting feature structured and arranged to engage a vertical support, wherein the first mounting feature extends outward from the pair of sidewalls and comprises a pair of projections and a pair of arms, the projections extending rearward and downward from the sidewalls, respectively, such that the projections are structured and arranged to engage a top portion of the horizontal support, and the arms extending rearward and laterally outward from the sidewalls, respectively, such that the arms are structured and arranged to engage a bottom portion of the horizontal support, wherein the second mounting feature is defined between the pair of sidewalls, and wherein the second mounting feature comprises at least first and second hooks formed on the bracket body, the first hook being structured and arranged to engage a first portion of the vertical support, and the second hook being structured and arranged to engage a second portion of the vertical support different from the first portion of the vertical support.

2. The bracket according to claim 1, further comprising a wire form coupled to the bracket body, the wire form providing a support adapted to receive a shelf.

3. The bracket according to claim 2, wherein the wire form is welded to the bracket body.

4. The bracket according to claim 2, wherein the shelf is welded to the wire form.

5. A storage system, comprising:

a horizontal support mounted to a surface;

a vertical support mounted to the surface or the horizontal support; and a first bracket comprising:

a bracket body defined by a front wall and a pair of sidewalls extending rearward from the front wall;

a first mounting feature defined by the bracket body, the first mounting feature structured and arranged to engage the horizontal support; and a second mounting feature defined by the bracket body and distinct from the first mounting feature, the second mounting feature structured and arranged to engage the vertical support, wherein the first mounting feature extends outward from the pair of sidewalls and comprises a pair of projections and a pair of arms, the projections extending rearward and downward from the sidewalls, respectively, such that the projections are structured and arranged to engage a top portion of the horizontal support, and the arms extending rearward and laterally outward from the sidewalls, respectively, such that the arms are structured and arranged to engage a bottom portion of the horizontal support, wherein the second mounting feature is defined between the pair of sidewalls, and wherein the second mounting feature comprises at least first and second hooks formed on the bracket body, the first hook being structured and arranged to engage a first portion of the vertical support, and the second hook being structured and arranged to engage a second portion of the vertical support different from the first portion of the vertical support.

6. The storage system according to claim 5, further comprising a wire form coupled to the body.

7. The storage system according to claim 6, further comprising a second bracket and a shelf, the shelf structured and arranged to be coupled to the wire forms of the first and second brackets.

8. The storage system according to claim 7, wherein the shelf is welded to the wire forms of the first and second brackets.

9. The storage system according to claim 5, wherein the horizontal support comprises a horizontal rail mounted to a garage wall, the vertical support being mounted to the garage wall or the horizontal rail.

10. The storage system according to claim 5, wherein the first mounting feature is structured and arranged not to engage the vertical support when the second mounting feature engages the vertical support.

11. The storage system according to claim 5, wherein the second mounting feature is structured and arranged not to engage the horizontal support when the first mounting feature engages the horizontal support.

12. The storage system according to claim 5, wherein the first mounting feature and the second mounting feature can simultaneously engage the horizontal support and the vertical support, respectively.

13. A bracket, comprising:

a bracket body defined by a front wall and a pair of sidewalls extending rearward from the front wall;

a first mounting feature defined by the bracket body, the first mounting feature structured and arranged to engage a horizontal support; and a second mounting feature defined by the bracket body and distinct from the first mounting feature, the second mounting feature structured and arranged to engage a vertical support, wherein the first mounting feature extends outward from the pair of sidewalls and comprises a pair of projections and a pair of arms, the projections extending rearward and downward from the sidewalls, respectively, such that the projections are structured and arranged to engage a top portion of the horizontal support, and the arms extending rearward and laterally outward from the sidewalls, respectively, such that the arms are structured and arranged to engage a bottom portion of the horizontal support, and wherein the second mounting feature extends outward from the front wall between the pair of sidewalls and comprises at least first and second hooks formed on the bracket body, the first hook being structured and arranged to engage a first portion of the vertical support, and the second hook being structured and arranged to engage a second portion of the vertical support different from the first portion of the vertical support.

14. The bracket according to claim 13, wherein the first hook extends rearward from the front wall proximate to a top portion of the front wall, and wherein the second hook extends rearward from the front wall proximate to a bottom portion of the front wall.

15. The bracket according to claim 13, wherein each of the arms includes a flange that extends laterally outward from a respective one of the sidewalls, such that the flanges are generally perpendicular to the sidewalls, respectively.

16. The bracket according to claim 14, further comprising first and second apertures formed in the front wall of the bracket body, wherein the first hook is disposed between the first aperture and a first sidewall of the pair of sidewalls, and wherein the second hook is disposed between the second aperture and the first sidewall.

* * * * *